United States Patent [19]

Droitsch et al.

[11] 4,246,924

[45] Jan. 27, 1981

[54] VALVE ARRANGEMENT

[75] Inventors: Lutz Droitsch, Bielefeld; Horst Wolff, Hohenschäafftlarn, both of Fed. Rep. of Germany

[73] Assignee: Speck Kolbenpumpenfabrik Otto Speck KG, Geretsried, Fed. Rep. of Germany

[21] Appl. No.: 15,157

[22] Filed: Feb. 26, 1979

Related U.S. Application Data

[63] Continuation of Ser. No. 795,762, May 11, 1977, abandoned.

[30] Foreign Application Priority Data

Feb. 4, 1977 [DE] Fed. Rep. of Germany ..... 2704754

[51] Int. Cl.[3] ..... G05D 11/03

[52] U.S. Cl. ..... 137/116

[58] Field of Search ..... 137/115, 116; 251/63.4, 251/83, 337

[56] References Cited

U.S. PATENT DOCUMENTS

| | | | |
|---|---|---|---|
| 1,457,957 | 6/1923 | Birkigt | 251/337 |
| 2,174,797 | 10/1939 | Magnuson | 137/115 |
| 2,264,375 | 12/1941 | Hill et al. | 137/116 |
| 2,312,877 | 3/1943 | Campbell | 137/116 |
| 2,313,351 | 3/1943 | Magnuson | 137/115 |
| 2,320,686 | 6/1943 | Waseige | 137/116 |
| 2,342,001 | 2/1944 | Magnuson | 137/116 |
| 2,397,117 | 3/1946 | Ashton et al. | 137/116 |
| 2,487,575 | 11/1949 | Mercier | 137/116 |
| 2,655,935 | 10/1953 | Kinzbach | 251/337 |
| 3,244,399 | 4/1966 | Jones et al. | 251/337 |
| 3,395,722 | 8/1968 | Heinrich | 137/116 |
| 3,451,416 | 6/1969 | Nyberg | 137/116 |
| 3,457,941 | 7/1969 | Cook | 137/116 |
| 3,575,192 | 4/1971 | MacDuff | 137/116 |
| 3,587,619 | 6/1971 | Krechel | 137/116 |
| 3,608,824 | 9/1971 | Ballou | 137/116 |
| 3,834,413 | 9/1974 | Peterson | 137/116 |
| 4,057,072 | 11/1977 | Cook | 137/116 |

*Primary Examiner*—William R. Cline
*Assistant Examiner*—H. Jay Spiegel

[57] ABSTRACT

A valve arrangement is disclosed for controlling the supply of an operating fluid, having a casing with an inlet port, a main flow path provided with a non-return valve extending from the inlet port to an operating outlet port and a secondary flow path extending from the inlet port to a by-pass outlet port, the secondary flow path containing a ball applied to a valve seat under spring prestressing to close said secondary flow path, there being provided a piston including a tappet operable to displace the ball from the seat, a spring for biasing the piston away from the ball, a flow path including a restrictor communicating pressure from the main flow path to said piston to displace the piston against the spring following an excessive rise in pressure in the main flow path, the structure permitting a predetermined stroke of the piston against the force of the spring prior to displacing the ball from its seat via the tappet.

8 Claims, 1 Drawing Figure

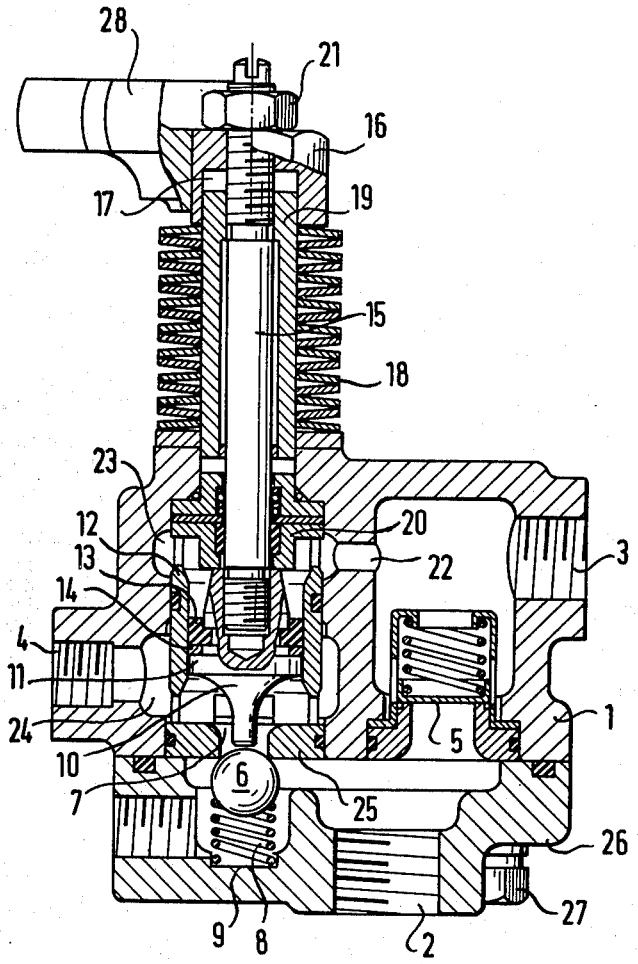
28
21
16
17
19
15
18
23
20
12
22
3
13
14
4
11
1
24
5
10
6
7
25
26
27
9
8
2

VALVE ARRANGEMENT

This is a continuation of application Ser. No. 795,762, filed May 11, 1977, now abandoned.

BACKGROUND OF THE INVENTION

The present invention relates to a valve arrangement, particularly a release valve for high pressure pumps.

Known valve arrangements of this type have a large number of disadvantages which are particularly based on the fact that due to flow resistances in the secondary flow path, there is a pronounced heating of the flow medium and therefore of the entire valve arrangement. This can lead to serious malfunctioning, whereby the release pressure at which the secondary path is opened cannot be precisely adjusted and more particularly over a relatively small pressure range, thus disturbing flow noises frequently occur in operation and that due to the construction, the space requirement for such valve arrangements is relatively large, making their operational use more difficult.

BRIEF SUMMARY OF THE INVENTION

An object of the invention is to provide a particularly compact valve arrangement, which is constructionally very simple and which can be easily fitted and maintained.

A further object of the invention is to provide a valve arrangement which makes it possible in the case of sudden blocking of the main flow path to rapidly and reliably switch over to a secondary flow path whilst maintaining the pressure in said known flow path.

A further object of the invention is to substantially eliminate the occurrence of flow of operating noises.

Another object of the invention is to prevent harmful temperature rises even in the case of frequent and long-standing operation of the secondary flow path.

A further object of the invention is to construct the valve arrangement in such a way that a large pressure adjusting range is maintained.

According to the invention, these objects are achieved by means of a valve arrangement comprising a casing with an inlet port, a main flow path provided with a non-return valve extending from said inlet port to an operating outlet port and a secondary flow path extending from the inlet port to a by-pass outlet port, whereby said secondary flow path contains a ball applied to a valve seat under spring prestressing, whereby said ball can be pressed out of the valve seat by means of an operating tappet if a piston of a cylinder-piston unit fixedly connected with said operating tappet is moved in the direction of the ball counter to the initial stressing force produced by a set of cup springs of an initial stressing unit through the pressure occurring in the main flow path via a predetermined stroke.

BRIEF DESCRIPTION OF THE DRAWINGS

Other and further objects of the present invention will be apparent from the following description and claims and are illustrated in the accompanying drawing which, by way of illustration, shows a preferred embodiment of the present invention and the principles thereof and what are now considered to be the best modes contemplated for applying these principles. Other embodiments of the invention embodying the same or equivalent principles may be used and structural changes may be made, if desired, by those skilled in the art without departing from the invention and the scope of the appended claims. The drawing shows a cross-section of the valve arrangement in the inoperative state.

DETAILED DESCRIPTION OF THE PREFERRED EMBODIMENTS

The drawing shows an unloader valve with a casing 1, having an inlet port 2 connected for example with the outlet of a reciprocating pump.

From inlet port 2, a main flow path leads to an operating outlet port 3 and a secondary flow path to a by-pass outlet port 4.

The main flow path contains a non-return valve 5 comprising a plate which is under the initial stress of a spring and is open if the particular medium flows from inlet port 2 to operating outlet port 3.

A valve is also arranged in the secondary flow path between inlet port 2 and by-pass outlet port 4. This valve comprises a ball 6, part of whose periphery engages in an opening 7 and is pressed against this opening by means of a helical spring 8, supported in a correspondingly shaped recess 9 of the casing.

An operating device, operating as a function of the pressure in the main flow path is associated with the valve formed by ball 6 and opening 7. The operating device acts on ball 6 via a tappet 10, whereby the latter is connected with a piston 11 or forms part of said piston 11 which can be moved into a cylinder 12.

Piston 11 is sealed relative to the inner wall of the cylinder by means of an elastic sealing member 13 and in addition a thrust ring 14 is provided which prevents the displacement of the sealing member and contributes to the centering of the piston.

Piston 11 is connected with a control rod 15 extending from the casing and supported via an adjusting nut 16 on a set of cup springs 18 resting on casing 1.

A guiding and centering sleeve 19 is arranged between the set of cup springs 18 and control rod 15 and its outer end engages in a recess 17 of adjusting nut 15 and whose inner end is guided in a casing bore.

Control rod 15 is led out of the casing through a sealing unit 20 which simultaneously bounds the pressure chamber 23 of the piston-cylinder unit and acts as a piston stop.

The pressure chamber 23 of the piston-cylinder unit is connected with the main flow path via a casing bore 22, whose axis is approximately at the same height as the axis of the operating outlet port 3, whose opening cross-section is however considerably smaller.

With opening 7, which can be closed by means of ball 6 and in which partly engages tappet 10 is linked an annulus 24 forming part of the secondary flow path.

The casing is preferably constructed in two parts having in addition to the main part a cover 26 connected to the main part by means of screws 27. The part of the casing located beneath the ball valve seat 25 is constructed as cover 26 and this special subdivision of the casing leads to considerable advantages in manufacture and fitting and in connection with any maintenance which may be required. The reason is that on removing casing cover 26, not only can the non-return valve 5 be easily moved, but in addition it is possible to remove virtually all the essential components of the operating device, i.e. the valve seat 25, cylinder 12 and sealing unit 20, because all these components are placed in a corresponding cylindrical recess which can have a somewhat different diameter for the individual components and can be held in the operating position by cover 26.

The release pressure can be adjusted by loosening a locknut 21 via adjusting nut 16 for which advantageously a handwheel 28 is provided.

Hereinafter, the operation of the above-described valve arrangement is explained.

In operation, a delivery pipe which comes for example from a pump is connected with the inlet port 2 and to the operating outlet port 3 can be connected an elastic hose leading to a spray gun which can be switched on and off by the operator. The by-pass outlet port is connected via a connecting line with the suction side of the same pump, so that if the main flow path is blocked and the secondary flow path comes into action, a closed circuit is formed.

The initial stressing force produced by the group of cup springs 18 and maintaining piston 11 in the inoperative position shown in the drawing via control rod 15 can by means of adjusting nut 16 be selected in such a way that an operation of the piston and consequently an opening of the valve located in the secondary flow path only takes place if a specific pressure increase, e.g. an increase of 10% occurs in the main flow path.

The opening of the valve located in the secondary flow path consequently takes place exclusively in a pressure dependent manner, which compared with the otherwise conventional flow volume regulation yields considerable advantages. In particular, the range of use of the valve arrangement is considerably increased because, with unchanged flow cross-sections and valve ports, it is possible to work with different quantities of fluid whilst, due to the pressure-dependent control a reliable and precise operation is always ensured.

Simultaneously, the valve arrangement is constructed in such a way that it permits a pressure regulation in the outgoing line in a particularly simple manner. If, for example, the adjusting force produced by the set of cup springs 18 via handwheel 28 is reduced so that, due to the pressure in the outgoing circuit, piston 11 is moved downwards somewhat and as a result tappet 10 forces ball 6 downwards and consequently the secondary flow path partly opens, so that accompanied by a pressure reduction in the outgoing circuit, part of the fluid supplied via port 2 flows back to the pump via the by-pass path. This possibility of simple pressure regulation has considerable practical significance because in this way it is possible to rapidly and easily, as well as without fluid loss and impairing operation to change from a high outgoing pressure such as is e.g. necessary for cleaning to a lower outgoing pressure such as is e.g. necessary after cleaning a stall or the like in order to spray a disinfectant. The operation of the unloader valve according to the invention is particularly significant in conjunction with the repeated and often long-lasting closure of the outgoing line, such as is for example the case in cleaning processes using a spray gun. As in such cleaning tasks and other applications, e.g. when spraying pesticides, it is necessary to work at very high pressures, it is a requirement that the spray guns operate according to a so-called dead man's circuit, i.e. immediately and necessarily the closed position becomes effective in such spray guns if the operator releases the release means. To avoid a dangerous pressure rise on closing the spray gun in the known arrangement, precautions are taken by means of an electric switch provided on the spray gun, electric lines running between the spray gun and the pump driving motor and relay circuits on the pump motor to ensure that on closing the spray gun, the pump motor is switched off via the electrical signal path, thereby preventing a pressure rise. The obvious disadvantages of these known arrangements are particularly that the electrical signal lines can be damaged easily constituting a considerable hazard, that the components of the electrical circuit, particularly the relays are susceptible to wear and expensive and that the frequent switching on and off of the pump guiding motor causes considerable heating and are therefore prejudicial to the motor. Furthermore, it is disadvantageous in the known solutions that it is impossible to work in areas where there is an explosion hazard and that whenever the motor is started up again, it is necessary to build up again the pressure drop which has occurred in the operating line. All the above-mentioned difficulties are obviated with the valve arrangement according to the invention. In the case of the embodiment shown in the drawing, in normal operation the fluid flows along the main flow path from the inlet port to the operating outlet port 3 with nonreturn valve 5 open. The pressure at outlet port 3 also acts on piston 11, because the pressure chamber 23 of the piston-cylinder unit is connected via bore 22 with the mainflow path.

If the main flow path is blocked by closing the spray gun or by a sudden blockage of the spray gun nozzle, the main flow path is immediately closed and the pressure wave caused by the sudeen closure is propagated rearwards and, accompanied by a simultaneous closure of the non-return valve 5 displaces piston 11 counter to the initial stressing force produced by the set of cup springs 18. As a result, tappet 10 is forced downwards against ball 6, so that opening 7 is freed and consequently the secondary flow path is connected through.

The excess pressure necessary for maintaining the deflected position of the piston is ensured either by the elasticity of the connecting tube or if a rigid connecting tube is used by a pressure reservoir connected with the main flow path.

When the secondary flow path is operational, the fluid passes from the inlet port 2 via valve opening 7 along the curved flow guidance surfaces of tappet 10 into annulus 24 and from there to the by-pass outlet port which, as indicated hereinbefore, is connected by a line with the pump inlet side. Due to the advantageous flow guidance in the secondary flow path the flow medium, e.g. water is fundamentally not heated in this operating phase. The avoidance of heating of the flow medium leads to the advantage that no steam is formed in the by-pass and consequently cavitation is prevented. Due to the special flow system, ball 6 is held in a substantially stable manner in the flow path as a result of the all-round flow which occurs.

When the spray gun is opened again, the pressure excess maintained in the main flow path due to the elasticity of the tube or the additional pressure reservoir is immediately reduced and the resulting pressure drop acts via bore 22 in the pressure chamber of the piston-cylinder unit so that the piston is drawn upwards by the set of cup springs and ball 6 immediately closes opening 7 again, whereby non-return valve 5 opens and the main flow path again becomes operational. It is important that due to maintaining the full pressure during the interruption of operation on starting up the spray gun again, the full pressure is immediately available and consequently no starting counter to the pressure is necessary. Thus, with regard to the necessary operating pressure, there is a substantially inertialess switchover.

The ball valve in the secondary flow path is advantageous not only due to its advantageous operation and its favourable shape from a flow standpoint, but also in the case where water is the flow medium, it is not sensitive to calcification, which has a positive action on the overall operation of the valve arrangement.

The use of cup springs as a force reservoir, in addition to the desired compact construction, leads to the advantages that large adjusting ranges are obtained with small adjusting paths and that it is possible to adjust to individual pressure values with high precision.

Advantageously, the valve arrangement is provided with a further connection (not shown in the drawing) for a pressure switch, said connection extending in the space between the inlet port 2, non-return valve 5 and ball valve 6. A correspondingly connected pressure switch can for example be used for controlling the switching on and off of an oil burner provided for heating the flow medium, so that the oil burner only operates when the known flow path is operational.

The invention is not limited to the embodiments described and represented hereinbefore and various modifications can be made thereto without passing beyond the scope of the invention.

What is claimed is:

1. A valve arrangement for controlling the supply of an operating fluid and comprising a casing with an inlet port, a main flow path provided with a non-return valve extending from said inlet port to an operating outlet port and a secondary flow path extending from the inlet port to a by-pass outlet port, said secondary flow path containing a ball applied to a valve seat under spring prestressing to close said secondary flow path, there being further provided piston means, including a tappet operable within a cylinder against the bias of spring means in response to excess pressure communicated via a passage from the outlet operating port to displace the ball from the seat thereby opening said secondary flow path, wherein the casing comprises first and second casing halves separated at a flat joint face, said first casing half having first and second cylindrical bores therein, the first bore being adapted to receive said non-return valve and communicating with said outlet operating port, and the second bore being adapted to receive said piston and said valve seat and communicating with said by-pass outlet port, said second casing half cooperating with said first casing half to define a cavity communicating with said inlet port and forming parts of said main and secondary flow paths respectively leading to said non-return valve and said valve seat and in which said spring prestressing is effected by spring means disposed outside of the first casing half and operable to draw said piston against a stop within said second cylindrical bore via an operating control rod.

2. A valve arrangement according to claim 1 and in which a clearance exists between said tappet and said ball when the piston is drawn against said stop.

3. A valve arrangement according to claim 2 and including adjusting means for adjusting the spring tension of said spring means, said adjusting means being located externally of said casing between said spring and said operating control rod.

4. A valve arrangement according to claim 1 in which sid piston is operable within a sleeve defining said cylinder, the sleeve being replaceably inserted into said second cylindrical bore.

5. A valve arrangement according to claim 4 and in which said valve seat bears on the end face of said sleeve and is held in place by said second casing half.

6. A valve arrangement according to claim 5 and in which said stop comprises a sealing member adapted to seal against leakage along the stem of the operating control rod and wherein said sealing member is trapped in position by said sleeve.

7. A valve arrangement according to claim 1, in which said ball applied to the valve seat under spring prestressing, and the spring therefor is located within said second casing half.

8. A valve arrangement according to claim 1 wherein said spring means comprises a series of stacked cup springs.

* * * * *